US005365713A

United States Patent [19]

Nicholas et al.

[11] Patent Number: 5,365,713

[45] Date of Patent: Nov. 22, 1994

[54] ELASTOMERIC SEISMIC SEAL SYSTEM

[75] Inventors: John D. Nicholas, Lawrenceville; David W. Rice, Decatur, both of Ga.

[73] Assignee: Pawling Corporation, Pawling, N.Y.

[21] Appl. No.: 990,006

[22] Filed: Dec. 14, 1992

[51] Int. Cl.[5] ..... E04B 1/684

[52] U.S. Cl. ..... 52/573.1; 52/396.03; 52/396.04

[58] Field of Search ..... 52/396, 403, 573, 396, 52/573.1, 396.03, 396, 04

[56] References Cited

U.S. PATENT DOCUMENTS

| | | | |
|---|---|---|---|
| 3,750,359 | 8/1973 | Balzer et al. | 52/573 |
| 3,880,539 | 4/1975 | Brown | 52/396 |
| 4,007,994 | 2/1977 | Brown | 52/396 |
| 4,447,172 | 5/1984 | Galbreath | 52/396 |
| 4,781,003 | 11/1988 | Rizza . | |
| 4,965,976 | 10/1990 | Riddle et al. | 52/396 |

OTHER PUBLICATIONS

C/S Expansion Joints, 2 pages.

1991 Seismic and Expansion Joint Systems for Construction, 2 pages The D.S. Brown Co.

Metalines Expansion & Seismic Joint Covers, 2 pages.

Applied Technology for the Expansion Joint Industry, 2 pages Erie Metals Specialties.

Omni-Move Architectural Joint Systems for Seismic and Expansion Control MM Systems Corporation 2 pages.

*Primary Examiner*—Carl D. Friedman

*Assistant Examiner*—Christopher Todd Kent

*Attorney, Agent, or Firm*—Schweitzer Cornman & Gross

[57] ABSTRACT

An elastomeric joint seal for architectural structures is provided with a multi-part cover and employs special anchoring hardware at least partially, and preferably entirely, mounted outside of the joint. The preferred mounting hardware comprises channels for receiving anchoring ribs of the multi-part cover. The main portion of the cover spans and seals the architectural joint, and is secured in the mounting hardware by anchoring ribs at each side. Cover strips are also anchored in the mounting hardware, and cover any exposed portions of the mounting hardware. The effective width of the joint is increased, by locating the mounting hardware outside of the joint space, which enables the joint to be designed to a narrower width dimension. The cover strips may be of a different color than the main seal to minimize the sight line. Significant economies are realized in the manufacture and installation, in part because the multi-part cover construction enables smaller and therefore less expensive extrusion equipment to be employed, and in part because the traditional difficulties involved in preparing the joint faces and in installing the mounting hardware within the joint space are avoided.

9 Claims, 4 Drawing Sheets

FIG. 1
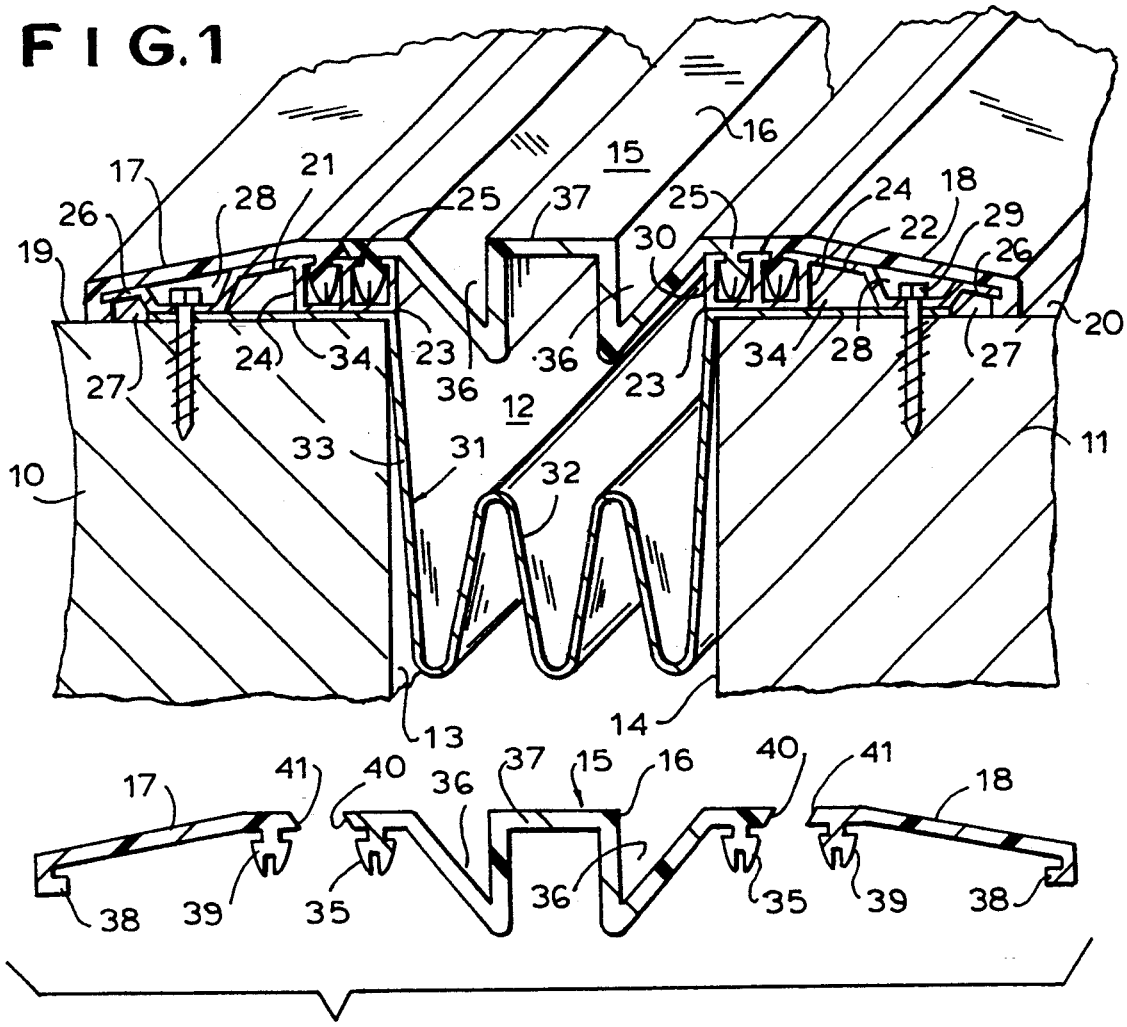
FIG. 2
FIG. 3
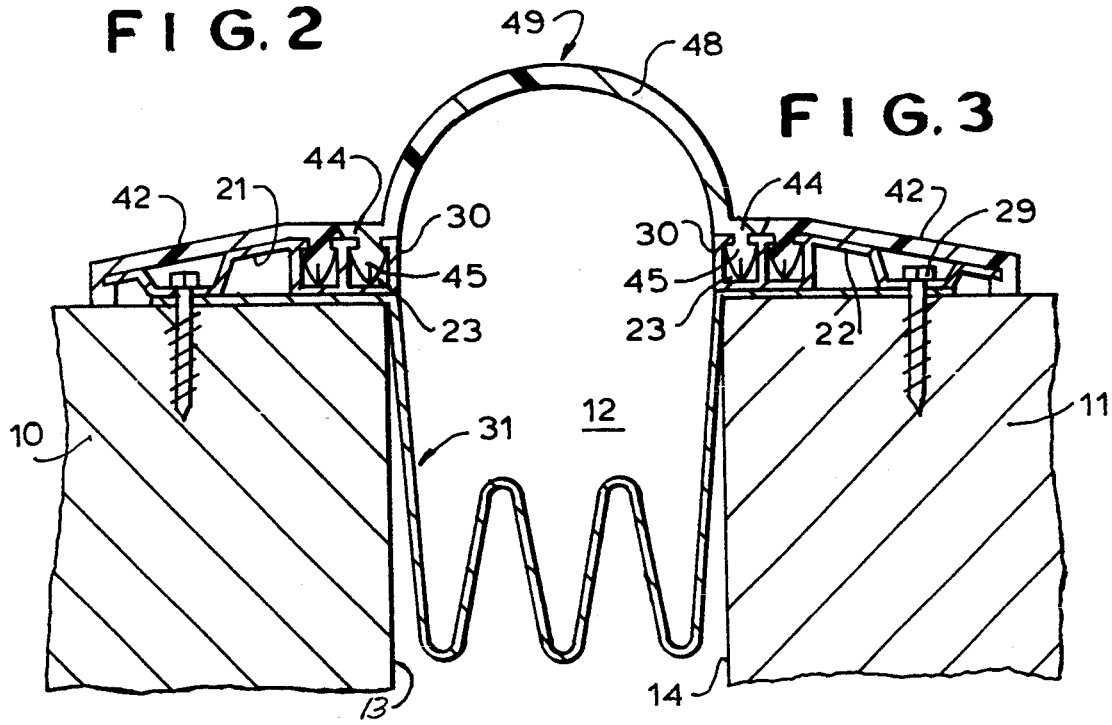

ELASTOMERIC SEISMIC SEAL SYSTEM

BACKGROUND AND SUMMARY OF THE INVENTION

In the design of large buildings and similar structures, it is increasingly common to design and build large structures in the form of a plurality of independent but connected structural units. The individual structural units are separated by expansion joints, which enable one structural unit to have relative movement with respect to its neighboring unit or units, such as typically might be expected to result from thermal expansion and contraction, wind pressures, or even seismic disturbances. Typically, such expansion joints are provided with elastic seals to provide weather-tight integrity as well as to mask the open space between adjacent structural units.

A commercially acceptable and successful expansion joint seal must effectively combine both functional and aesthetic characteristics. Frequently, functional requirements can tend to be inconsistent with aesthetic requirements, leading the designers to incorporate various trade-offs and compromises.

The present invention is directed to specific improvements in expansion joint seals of a generally known type with the objective of improving the joint seal both functionally and aesthetically. Additionally, the invention is directed to an expansion joint construction having improved functional/aesthetic features which at the same time can be more economical to manufacture and install.

In representative prior art structures, such as, for example, reflected in the Riddle et al. U.S. Pat. No. 4,965,976 and/or the Rizza U.S. Pat. No. 4,781,003, it has been the practice to install at least portions of the seal-mounting hardware within the joint in order, among other reasons, to minimize the sight line of the joint seal. Even where portions of the mounting hardware are installed externally of the joint, as in the Riddle et al. U.S. Pat. No. 4,965,976, the external mounting hardware is at least partially projected into the space of the joint in order to minimize the exposed surfaces of the seal and thus minimize the exposed width or sight line of the seal. Historically, architects have been rather insistent with respect to minimizing the sight line of a joint, and this has dictated many compromises in the functional performance of the joint.

In accordance with the present invention, an expansion joint seal is provided which incorporates mounting hardware strips, which are installed on opposite sides of an expansion joint, but in manner to be entirely clear of the joint space. Additionally, the elastomeric seal, which is installed in the mounting hardware, is of a unique multi-part design. The multi-part seal includes a principal sealing member, which is secured at each side in the mounting hardware, spans the open space of the expansion joint, and constitutes the primary expansion joint seal. The mounting hardware includes means for separately mounting and retaining cover strips, which laterally abut the main sealing strip and form, in effect, lateral extensions thereof. The principal function of the cover strips is to provide a transition to the surfaces of the adjacent structural units, and to completely cover the edges of the mounting hardware.

By positioning the mounting hardware to be completely clear of the joint space, the overall width of the elastomeric seal may be wider than in a conventional seal construction, and this would normally be undesirable. However, in accordance with the present invention, the lateral cover strips can be of a different color than the primary sealing strip, so as to effectively mask the actual width of the sealing strip and give it the appearance of a much narrower strip.

An important functional advantage derived from the described arrangement is that, by eliminating mounting hardware from the interior of the joint, a much greater closing movement of the joint can be tolerated than with more conventional designs and/or the joint may be designed to be substantially narrower than is enabled with conventional installations. In addition, economies are realized in both the manufacture of the joint and in its installation. Because the seal is an assembly of three elements of two different designs, instead of a single wide sealing element, the extrusion die required is both simpler and smaller, and smaller extrusion equipment can be utilized in the production of the seal. Alternatively, the seal may be designed to much larger sizes than has been practical heretofore. Significant economies are also realized in the installation by reason of the greater ease of installing the mounting hardware on the outer surfaces of a structure, rather than within the joint. Particularly, where the joint is located at a corner, it is extremely difficult to install mounting hardware within the joint space. Moreover, where the opposed joint faces are irregular, conventional installation requires that the joint faces be re-worked and smoothed. This can be a difficult and expensive undertaking, which is completely avoided by the system of the invention.

For a more complete understanding of the above and other features and advantages of the invention, reference should be made to the following detailed description of a preferred embodiment of the invention and to the accompanying drawings.

DESCRIPTION OF THE DRAWINGS

FIG. 1 is a transverse cross sectional illustration of one advantageous form of elastomeric seal according to the invention, for installation on generally co-planar surfaces of adjacent structural units.

FIG. 2 is an exploded cross sectional view of the elastomeric sealing element employed in the seal structure of FIG. 1.

FIGS. 3 and 4 are cross sectional views, similar to FIG. 1, illustrating modified forms of elastomeric sealing elements.

DESCRIPTION OF PREFERRED EMBODIMENTS

Figure 4:
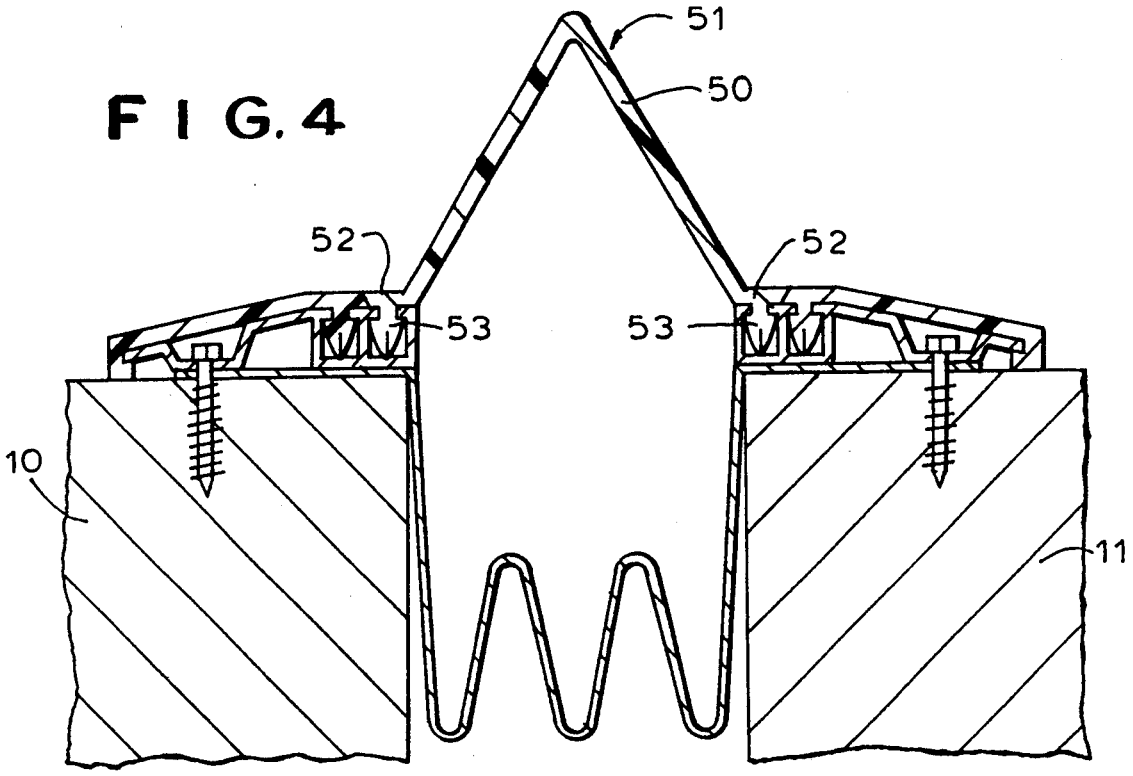

Referring now to the drawings, and initially to FIGS. 1 and 2 thereof, the reference numerals 10, 11 designate generally adjacent structural units, such as portions of a building or other structure. By design, the two structural units are separated by an expansion joint 12, which constitutes a predetermined space between the adjacent, opposed walls or joint faces 13, 14 of the structural units. The space provided by the expansion joint 12 enables the structural units to move independently according to design parameters, in order to accommodate both normal movements caused by environmental conditions, and also the motion caused by seismic activity.

Customarily, the expansion joint 12 is suitably sealed against weather, in some cases provided with thermal barrier means, and frequently is provided with a cover for aesthetic purposes. Without suggesting any limitation, the illustrated and described embodiments of the present invention incorporate an environmental seal and an aesthetic cover, but do not illustrate any provision for thermal barrier.

In accordance with the invention, the outer cover for the expansion joint 12 is comprised of a multiple piece elastomeric cover element, generally designated by the reference numeral 15 in FIG. 1. In the particular embodiment of FIG. 1, the cover element 15, shown in an exploded view in FIG. 2, is comprised of three strip-like segments, including a central sealing strip 16, which is of a size and shape to span the space of the expansion joint, and cover strips 17, 18 which are disposed on opposite sides of the central sealing strips. The strip sections 16-18 are extruded in more or less continuous lengths, of a suitable elastomeric material capable of flexing and stretching as necessary to accommodate predicted movements of the structural units.

On the upper surfaces 19, 20 of the respective structural units, on opposite sides of the joint space 12, there are elongated mounting strips 21, 22, typically formed of extruded aluminum, which extend along substantially the full length of the joint 12. Pursuant to the invention, the mounting strips 20, 21 are provided along their inner edges with retaining channel means which, in the illustrated embodiments take the form of side-by-side retaining channels 23, 24, each formed with a restricted opening 25. Laterally outward of the retaining channels 23, 24, the surface of the mounting strips angles downward and outward, terminating at a flange lip 26 spaced a short distance above the bottom surfaces of the mounting strips, so as to provide a clearance space 27 above the surface of the structural unit, when the mounting strips are installed.

In the illustrated structures, the mounting strips 21, 22 are formed with longitudinally extending channels 28 forming recesses for receiving mounting screws 29 at suitably spaced intervals.

Pursuant to a preferred embodiment of the invention, the mounting strips 21, 22 are anchored to the structural units 10, 11 in such a way that the inner walls 30 thereof are positioned in substantial alignment with the joint faces 13, 14 of the structures, or at least so as not to project significantly into the space 12.

Desirably, at the time of securing the mounting strip 21, 22, a flexible elastomeric environmental seal element 31 is secured in place being tightly clamped by the mounting strips when they are secured by the screws 29. As illustrated in FIG. 1, the environmental seal 31 is formed with a central portion 32 which easily expands and contracts. A bellows-type construction is suitable for this purpose. The seal also includes upwardly extending sidewalls 33 and laterally extending flange portions 34 which extend out over the top surfaces 19, 20 of the structural units and are clamped firmly in place by the mounting strips 21, 22. If desired, the environmental seal may be secured in special retaining channels (not shown) provided for that purpose in the retaining hardware.

As shown in FIG. 2, the central sealing strip 16 of the cover section is provided with longitudinally extending anchoring ribs 35 at each side. By way of illustration, the anchoring ribs may be formed with a cross sectional shape somewhat similar to an arrowhead, barbed spline or the like, and these anchoring ribs are arranged to be forcibly inserted into the retaining channels 23 of the respective mounting strips 21, 22, at each side of the expansion joint. The opposite edge portions of the strip section 13 are thus permanently anchored to the respective structural units.

The central strip section must be designed to accommodate both separating and closing movements of the structural units. Any suitable cross sectional configuration can be employed for this purpose. In the illustration of FIG. 1, the central strip section 16 is configured to provide a pair of upwardly opening V-shaped sections 36, connected by a horizontal section 37. The two V-shaped sections accommodate easy distortion of the strip section 15 pursuant to closing and separating movements of the structural units.

Pursuant to the invention, the covering strips 17, 18 are formed at their outer edge portions with short, inwardly projecting return flanges 38, which are arranged to be received underneath the flange lips 26 and to project into the clearance spaces 27 (FIG. 1). Adjacent the inner edges of the cover strips there are continuous, longitudinally extending anchoring ribs 39, which can have a cross sectional configuration generally the same as the anchoring ribs 35 of the central strip, for example in the form of an arrowhead or barbed spline. The cover strip anchoring ribs 39 are arranged to be press-fitted into the retaining channels 24 of the mounting strips, after first engaging the return flanges 38 underneath the lips 26 of the mounting hardware.

To advantage, the confronting edge surfaces 40, 41 of the central sealing strip 16 and the respective cover strips 17, 18, are arranged to abut at an acute angle to the horizontal, so that the surfaces 41 partially underlap the surfaces 40 of the central sealing strip (or vice versa).

Multi-piece construction of the cover strip 15 enables multiple benefits to be realized. Importantly, it allows the mounting hardware, in the form of the aluminum strips 21, 22 to be mounted substantially flush with the joint faces 13, 14 of the structural units. With a one piece cover strip, such an arrangement would be unacceptable to most architects, and therefore commercially unsatisfactory, because of the greater overall width of the cover strip necessitated by the greater separation of the mounting strips. With the arrangement of the invention, however, the respective cover strips 17, 18 can be made of a different color than the central sealing strip 16 so that, although the cover strip is in fact wider than conventional, to the casual eye it appears narrower. Moreover, color variations may be utilized to provide a desirable decorative enhancement.

An additional benefit of the multi-part construction of the cover strip is that the three piece assembly of the joint cover enables manufacture to be carried out by extrusion of two relatively narrow pieces, rather than by the extrusion of a single, wide section, which would is necessitated with a one piece cover, even where the mounting hardware is projected partway into the clearance space in accordance with conventional practice. In this respect, it will be understood that, although the structure shown in FIG. 2 is of three pieces, the respective cover strips 17, 18 are of identical section and constitute a single extrusion in the manufacturing process. The use of two, relatively narrow extrusion sections enables the extrusion dies to be much less expensive than otherwise, and also enables the elements to be produced on smaller, and therefore less expensive extrusion equipment. As an alternative, where necessary or appropriate, a multi-part joint cover can be designed to be utilized with a larger joint space than could be accommodated with a one-piece cover strip.

The embodiment of FIG. 3 is similar in many respects to that of FIG. 1, except that the central or sealing section 48 of the joint cover 49 has a convex, generally semi-cylindrical contour to accommodate the desired flexing and distorting motion. The cover 48 is of three-piece construction, and the cover strips 42, 43 at each side may be of identical construction to the cover strips 17, 18 of FIGS. 1 and 2. The mounting hardware for the FIG. 3 embodiment comprises extruded aluminum strips 21, 22 identical to those shown in FIG. 1. According to the invention, these are mounted so as to have the inner walls 30 substantially aligned with the opposed joint faces 13, 14 of the structural units 10, 11, defining the joint space 12. The sealing strip 48 is configured at its edges to provide outwardly laterally extending flanges 44 from which project anchoring ribs 45 of generally arrow shaped cross sectional configuration arranged to be received and secured in the retaining channels 23. An environmental seal 31 is secured by the mounting strips 21, 22, as described in connection with the embodiment of FIG. 1.

The embodiment of FIG. 4 is similar to that of FIG. 3, except that the central section 50 of the joint cover 51 is of an inverted, V-shaped configuration, to accommodate the expected motion of the structural units 10, 11. The sealing strip 50 is provided at its edges with outwardly extending flanges 52 carrying anchoring ribs 53. In all other respects, the installation of FIG. 4 corresponds to those of FIGS. 1–3.

Figure 5:
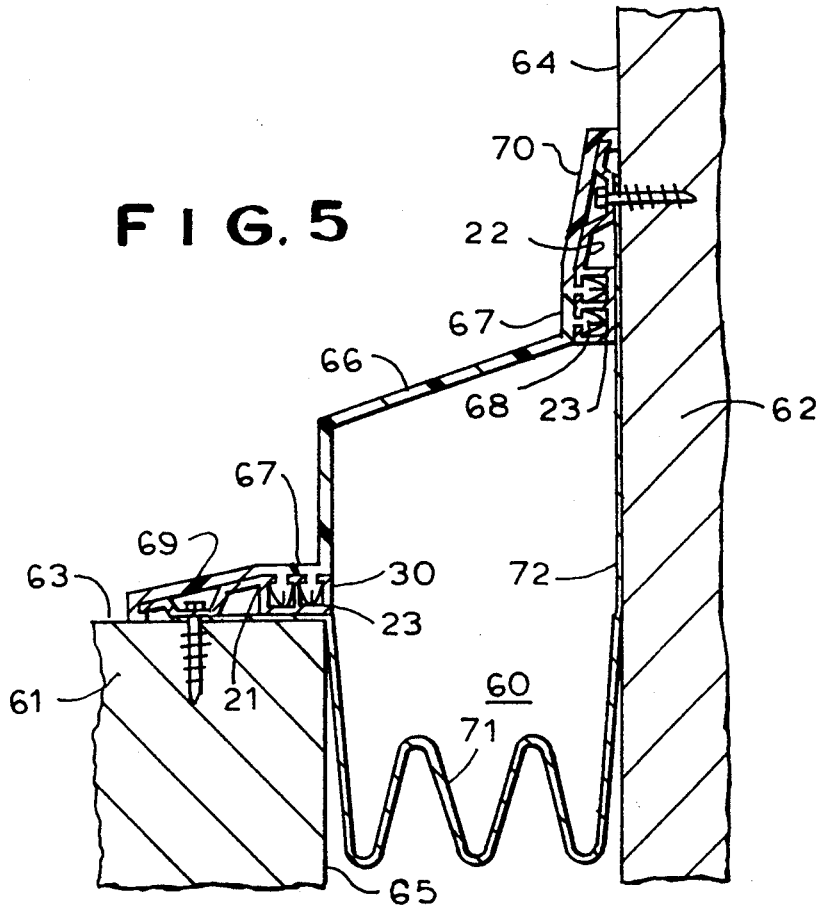
FIGS. 5 and 6 are cross sectional illustrations of joint seals constructed in accordance with the invention, for installation at a corner.
Figure 6:
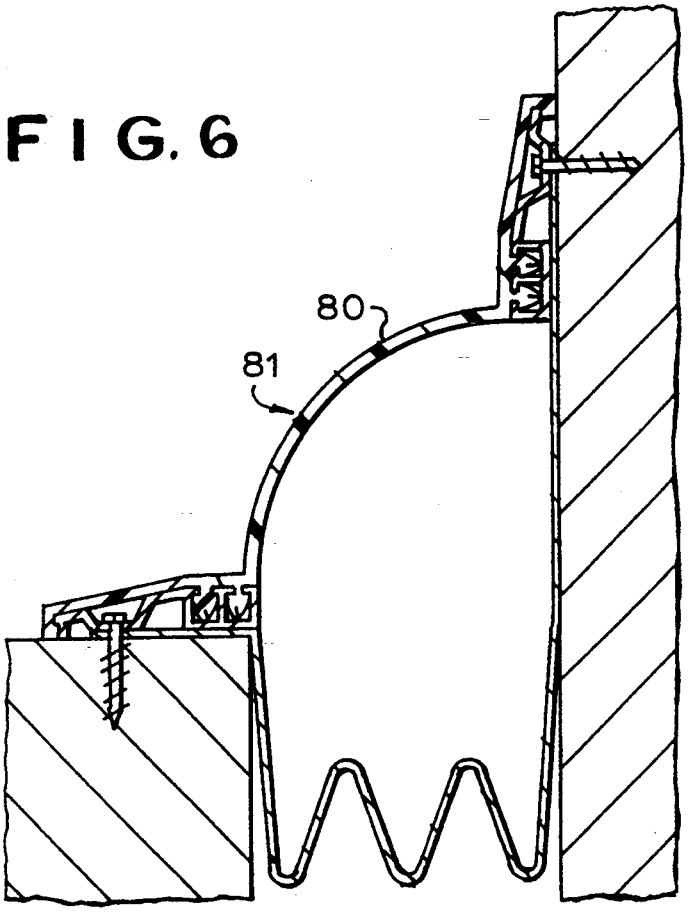

FIGS. 5 and 6 illustrate an application of the principles of the invention to an installation in which an architectural joint 60, between structural units 61, 62, is located at a corner, where the available principal surfaces 63, 64 of the respective structures are at right angles.

In the illustration of FIG. 5, the structural unit 61 has one exposed surface 65 which defines one side of the joint space 60. The surface 63, upon which the joint seal is to be mounted, is disposed at right angles thereto. The second structural unit 62 has a single surface 64 which not only defines the opposite side of the joint space 60, but also provides the surface for mounting of the hardware for the joint seal.

A first mounting strip 21, in all respects, similar to that of FIG. 1, is mounted on the surface 63, with its inner wall 30 substantially aligned with the surface 65 facing the joint space. A second mounting strip 22 is mounted on the opposite wall, oriented at right angles to the mounting strip 21 so as to effectively preclude interference between the two mounting strips during predictable motions of the structural units 61, 62.

In the FIG. 5 embodiment, a sealing strip 66 spans the open space between the respective mounting strips 21, 22. At each side edge, the sealing strip is provided with an angularly projecting flange 67 from which projects an anchoring rib 68 arranged to be received and tightly retained within the retaining channels 23 of the mounting strips. Cover strips 69, 70, which are in all respects similar to the cover strips 17, 18 of FIG. 1, are secured to the mounting strips 21, 22 and are arranged to closely and snugly abut the edges of the center of the sealing strip 66 so as to form, in effect, a continuation of the flanges 67 thereof.

In the modification of FIG. 5, an environmental seal 71 is anchored at one side underneath the mounting strip 21, substantially as described in connection with FIG. 1. At the opposite side, the environmental seal has a wall portion 72 of sufficient length to extend under and be anchored by the opposite mounting strip 22.

The modification of FIG. 6 is largely identical to that of FIG. 5, with the principal exception that the sealing strip portion of the joint portion 80 of the joint cover 81 is of arcuate cross section, whereas the cross section of the cover strip 66 in FIG. 5 is of angular shape. In either case, the configuration is to provide reasonable aesthetics while at the same time accommodating relative motion of the structural units within a design range.

Figure 7:
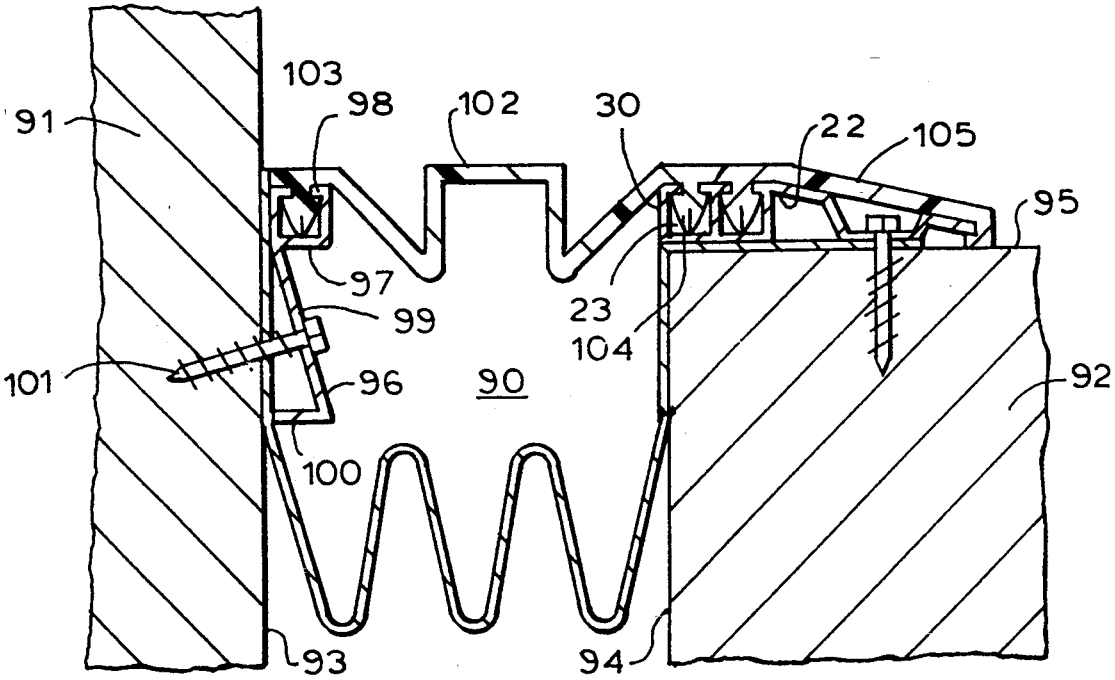
FIG. 7 is a cross sectional illustration of a hybrid corner seal installation, in which mounting hardware is partially installed within the joint at one side, and elements of the seal of the invention are otherwise utilized.

The embodiment of FIG. 7 is a hybrid form, which retains some of the characteristics of prior art structures while enjoying some, albeit less than all of the advantages of the invention. The embodiment of FIG. 7 is intended for use in sealing an expansion joint 90 between adjacent structural units 91, 92, where the joint space is located at a corner and where, as a result, one side of the expansion joint cover must be anchored on a surface 93 which defines one side of the expansion joint. Pursuant to the invention, a multi-part joint cover is employed, although in the FIG. 7 embodiment only two parts are utilized, instead of the three parts employed in the embodiments previously described.

On the structural unit 94, which has one surface 94 defining one side of the expansion space and another surface 95 at right angles thereto, a mounting strip 22, in all respects identical to that shown in FIG. 1, is secured to the surface 95, with its inner wall 30 substantially flush with the wall 94.

At the opposite side, a mounting strip 96 is provided, which is of conventional design. The mounting strip 96 comprises a continuous extrusion, preferably of aluminum, which is formed at its upper end with a retaining channel 97 provided with a restricted upper opening 98, generally corresponding to the retaining channel 23 of the opposite side mounting strip 22. The conventional mounting strip includes an angularly disposed panel 99 which is integrally joined along its upper edge with the retaining channel and extends downward and outward therefrom, joining with at its lower end with an angular flange 100 which projects toward the wall surface 93. The upward tilt of the panel 96 facilitates access thereto from the top of the joint space 90 for securing the mounting strip by means of downwardly angled screws 101.

Conventionally, the mounting strip 96 would be mounted so that the top of its retaining channel 97 was at or slightly below the level of the opposite surface 95. In the installation according to the invention, however, this conventional mounting strip is elevated so as to be on the same level as the retaining channel 23 of the opposite side mounting strip 22. Among other things, this makes the conventional mounting strip 96 easier to install.

According to the invention, a sealing strip 102, which may for example correspond to the sealing strip 16 of the FIG. 1 embodiment, is mounted at opposite sides by retention of opposite side anchoring ribs 103, 104 in the respective retaining channels 97, 23. A cover strip 105, which in all respects corresponds to the cover strip 18 of FIG. 1, is anchored in the mounting strip 22 in the manner previously described. In the modification of FIG. 7, the mounting strip 96 is partially contained within the expansion space 90, and therefore partially limits the available movement of the structures 91, 92, without causing damage. As compared to a conventional installation, however, the arrangement of FIG. 7 has the important advantage of having only one, instead of two sets of mounting hardware contained in the expansion space, as the mounting strip normally anchored on the vertical wall 94 is replaced by the dual channel mounting strip 22 secured to the horizontal surface 95. Additionally, and of considerable practical significance, the securing of a conventional mounting strip as shown at 96 to the face of the opposite wall 94 is extraordinarily difficult, where the structure presents a corner condition. Special tools are necessitated, in order to allow the necessary holes to be drilled, and mounting screws to be installed. At best, the task is time consuming and labor intensive. All of this is avoided by providing a double channel mounting strip 22, anchored to the readily accessible upper surface 95.

Figure 8:
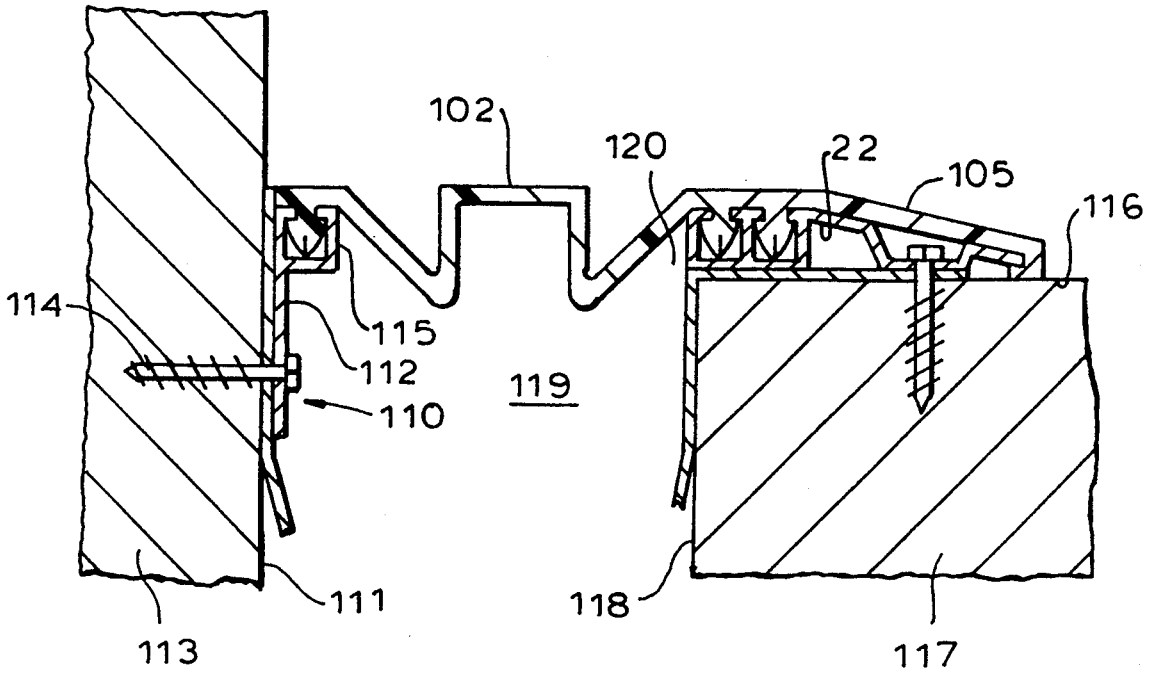
FIG. 8 is a cross sectional illustration, similar to FIG. 7, showing a further form of hybrid installation, in which the mounting hardware, although partly projecting into the joint space, nevertheless does not effectively interfere with the joint space.

The embodiment of FIG. 8 is similar in many respects to the hybrid installation of FIG. 7 although modified further in order to greatly minimize the effective reduction of joint space by reason of the mounting hardware. In particular, a mounting strip 110, which is installed on the end joint face 111, comprises a flat mounting section 112, which is secured to the structural 113 by screws 114 and which is integrally joined at its upper end with a channel-forming section 115 of a configuration similar to the retaining channel 97 of the FIG. 7 embodiment. A mounting strip 22, secured to the upper surface 116 of the opposed structural unit 117 is offset back from the joint face 118 by an amount corresponding generally to the projected offset of the retaining channel portion 115 with respect to the flat mounting section 112 of the opposed mounting strip 110. The arrangement is such that, if the two structural units 113, 117 approach each other to reduce the joint space 119 to a near-zero condition, the projecting portion 115 of the mounting strip 110 can be received in the recess space 120 provided by the rearward offset of the mounting strip 22. Thus, the embodiment of FIG. 8, while in general being similar to that of FIG. 7, accommodates a greater relative motion of the structural units 113, 117, and/or the design of a smaller nominal joint space 119, or some combination of those two advantageous features.

In the embodiment of FIG. 7, although the overall joint cover exposed to the eye is somewhat wider than otherwise, the cover strip 105, being a separate component, can be formed of a material of different color to minimize the visual effect of the greater width and/or to provide a desirable decorative feature.

In its basic form, the sealing system of the invention incorporates a multi-part elastomeric seal, comprised of a primary sealing strip constructed to accommodate the expected motion of adjacent structural units, and one or more separate cover strips mounted immediately adjacent to the primary sealing strip and, where desired, formed of a different colored material. The cover strips are not required to accommodate relative motion.

In conjunction with the multi-part joint seal, the system of the invention includes novel mounting strips provided with retaining channel means for the reception of anchoring ribs provided at the opposite edges of the primary sealing strip, and at one edge of the cover strips. Preferentially, the retaining channel means comprises a pair of side-by-side channels. However, it is contemplated that the retaining channel means may also be in the form of a single, wider channel, capable of receiving anchoring ribs of both the sealing and covering strips. Likewise, it is contemplated that separate retaining channels, if employed, may be spaced apart somewhat.

The system of the invention, in its principal form, allows the mounting hardware for the joint cover seal to be mounted entirely outside of the joint space such that, in a given installation, the permissible motion of the structural units, without damage to the sealing system, is significantly enlarged and/or the designed width of the joint space may be made smaller without compromising its function. This is only partially true, of course, in connection with the embodiment of FIG. 7, but even there, there is a significant increase in the range of motion permitted by reason of the fact that the mounting hardware at one side of the joint is located outside of the joint space.

Whereas simply locating the mounting hardware outside of the joint space is a seemingly evident solution to the problem of joint space restriction, there are important practical difficulties derived in part from the fact that architects have a tendency to refuse to specify systems where the observable seal is inordinately wide. Accordingly, in prior art systems, even where the mounting hardware has been mounted outside of the joint space, it has been projected into the joint space in order to reduce overall width (e.g., Riddle et al. U.S. Pat. No. 4,965,976). In the system of the present invention, on the other hand, by providing mounting strips with dual, side-by-side retaining channels, and constructing the joint seal in a multi-part fashion, it becomes possible and practical to locate the mounting strips entirely outside of the joint space and at the same time satisfy the aesthetic concerns with respect to excessively wide sight lines. By providing for the lateral strip covers to be of a different color than the central sealing strip, the visual effect of the wider structure can be effectively concealed. Indeed, in some cases, the color selection can be such as to achieve a highly desired striped decorative effect, while at the same time enjoying structural advantages with respect to the location of the mounting hardware.

In addition to all of the above advantages, there are economies realized in the manufacture of the joint cover in two component parts, each of a fraction of the overall width of the assembled cover. This permits the use of smaller extrusion dies and smaller extrusion equipment and hence lower production costs. Additional important economies are realized from the ability to install all of the mounting hardware outside of the joint space. With more conventional systems, where the joint faces are irregular, it may be necessary to perform difficult and expensive re-working of the joint faces to provide a flat, even bed for hardware installation.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. In a sealing system for an architectural joint separating adjacent structural units, wherein the structural units have confronting, spaced-apart joint faces defining a joint space and wherein at least one of the structural units has an external surface disposed at a substantial angle to said joint faces, and which comprises, (a) a first elongated mounting rail adapted to be secured to said external surface of said one structural unit and extending along one side of said joint space, (b) said first mounting rail having longitudinally extending first cover strip-anchoring means adapted to be positioned adjacent to but without projecting significantly into said joint space, (c) a second elongated mounting rail adapted to be secured to the other of said structural units and having second longitudinally extending cover strip-anchoring means, and (d) a third cover strip-anchoring means being positioned adjacent to said first cover strip-anchoring means on said first mounting rail, (e) an elongated sealing cover, formed of elastomeric material and adapted to flexibly span said joint space and overlying said mounting rails in order to cover and conceal said mounting rails, the improvement characterized by, (f) said sealing cover being of multi-part construction and including a first elongated cover strip element having a distortable central portion flexibly spanning said joint space between said first and second elongated mounting rails, and provided adjacent opposite side edges thereof with longitudinally extending anchoring means adapted for interlocking engagement with cover strip-anchoring means of said first and second mounting rails, and (g) at least one elongated second cover strip element, coextensive with said first cover strip element and separate therefrom, extending along and covering all exposed portions of said first mounting rail, (h) said second cover strip element being provided with longitudinally extending anchoring means adapted for interlocking engagement with said third cover strip-anchoring means, (i) said second cover strip element being a physically separate element from said first cover strip element and having a side edge substantially abutting with an adjacent side edge of said first cover strip element, to form an effectively continuous cover completely concealing said first and second mounting rails.

2. A sealing system according to claim 1, further characterized by (a) the other of said structural units having an external surface disposed at a substantial angle to said joint faces, (b) said second mounting rail being adapted to be secured to the external surface of said second structural unit and extending along the other side of said joint space, (c) said second mounting rail having longitudinally extending first cover strip-anchoring means adapted to be positioned adjacent to but without projecting significantly into said joint space, (d) a third elongated cover strip element extending along and covering all exposed portions of said second mounting rail and being provided with longitudinally extending anchoring means adapted for interlocking engagement with first cover strip-anchoring means of said second mounting rail, (e) said third cover strip element being a physically separate element from said first cover strip element and having a side edge substantially abutting with an adjacent side edge of said first cover strip element, to form an effectively continuous cover completely concealing said first and second mounting rails.

3. A sealing system according to claim 2, further characterized by (a) said second and third cover strip elements being of the same cross sectional configuration.

4. A sealing system according to claim 1, further characterized by (a) the cover strip-anchoring means of said first mounting rail comprising a pair of side-by-side, longitudinally extending channels having upwardly directed restricted outer openings, and (b) the anchoring means provided on said first and second cover strip elements comprising longitudinally extending downwardly projecting ribs of cross section adapted for locking reception within said channels.

5. A sealing system according to claim 1, further characterized by (a) said first mounting rail having an edge flange extending along an edge thereof remote from said joint space and spaced from said cover strip-anchoring means, (b) said edge flange being spaced from said external surface, (c) said second cover strip element being provided along one edge with a return flange arranged for interlocking engagement with said edge flange, whereby said cover strip is secured in position on said mounting rail by said cover strip-anchoring means and said edge flange.

6. A sealing system according to claim 1, further characterized by (a) said second mounting rail having the same cross sectional configuration as said first mounting rail, (b) the joint face of said second structural unit having extending wall portions projecting beyond the external wall of said first structural unit to define with said external wall a corner configuration, (c) said second mounting rail being adapted to be secured to the projecting wall portions of said second structural unit parallel to said first mounting rail and positioned on the opposite side thereof from said joint space, whereby said mounting rails are prevented from contact during closing of said joint space, (d) said second mounting rail being oriented at a substantial angle relative to the first mounting rail, and (e) a third elongated cover strip extending along and substantially covering exposed portions of said second mounting rail, (f) said third cover strip being separate from said sealing cover and having a side edge substantially abutting with an adjacent side edge of said sealing cover.

7. A sealing system according to claim 1, further characterized by (a) said second mounting rail is installed partially within said joint space but with at least portions of said second mounting rail projecting out of said joint space.

8. A sealing system according to claim 7, further characterized by (a) said cover anchoring means of said second mounting rail being adapted to be disposed outside of said joint space and generally aligned with the cover anchoring means of said first mounting rail, and (b) said first mounting rail being offset away from said joint space to provide a space for reception of the cover anchoring means of said second mounting rail in the event of substantial closing of said joint space.

9. A sealing system according to claim 1, further characterized by (a) said second and third cover strip elements being formed of an elastomeric material of color distinguishable from the color of said first cover strip element.

* * * * *